US012728974B1

(12) United States Patent
Hiner et al.

(10) Patent No.: US 12,728,974 B1
(45) Date of Patent: Sep. 8, 2026

(54) MARINE DRIVES AND COOLING PUMPS FOR MARINE DRIVES

(71) Applicant: Brunswick Corporation, Mettawa, IL (US)

(72) Inventors: Kyle C. Hiner, Brandon, WI (US); Scot A. Fischer, Oakfield, WI (US); Robert A. Stellmacher, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 499 days.

(21) Appl. No.: 18/202,095

(22) Filed: May 25, 2023

(51) Int. Cl.

| | |
|---|---|
| ***B63H 21/38*** | (2006.01) |
| ***F04D 3/00*** | (2006.01) |
| ***F04D 29/08*** | (2006.01) |
| ***F04D 29/52*** | (2006.01) |
| ***F04D 29/58*** | (2006.01) |

(52) U.S. Cl.
CPC ..... *B63H 21/383* (2013.01); *F04D 3/00* (2013.01); *F04D 29/086* (2013.01); *F04D 29/528* (2013.01); *F04D 29/5806* (2013.01)

(58) Field of Classification Search
CPC ... B63H 21/383; F04D 29/041; F04D 29/042; F04D 29/126; F04D 29/622; F04C 27/006; F04C 27/007
USPC ..... 418/135
See application file for complete search history.

(56) References Cited

U.S. PATENT DOCUMENTS 2,455,194 A 11/1948 Rumsey
2,460,421 A 2/1949 Kincannon
2,466,440 A 4/1949 Kiekhaefer
2,536,374 A 1/1951 Kincannon
4,392,779 A * 7/1983 Bloemers ..... F04C 2/44 415/217.1
4,433,967 A 2/1984 Craig
(Continued)

FOREIGN PATENT DOCUMENTS

CA 1164729 A 4/1984
CN 109236671 A 1/2019
(Continued)

OTHER PUBLICATIONS

Office Action issued in U.S. Appl. No. 19/197,138, dated Jan. 21, 2026.

*Primary Examiner* — Kenneth J Hansen
(74) *Attorney, Agent, or Firm* — Andrus Intellectual Property Law, LLP

(57) ABSTRACT

A pump for pumping cooling fluid to cool a marine drive comprises a pump housing defining a chamber and an impeller in the chamber. The impeller is rotatable about an axis, and the pump is configured to automatically adjust and maintain an axial compression force on the impeller so as to maintain a consistent seal between the impeller and the pump housing. In other examples, a marine drive comprises an inlet configured to receive cooling fluid and a pump configured to pump the cooling fluid to cool a component of the marine drive. The pump comprises a pump housing that defines a chamber and an impeller compressed in the chamber. The impeller is rotatable about an axis, and the pump is configured to automatically adjust and maintain an axial compression force on the impeller so as to maintain a consistent seal between the impeller and the pump housing.

20 Claims, 5 Drawing Sheets

(56) References Cited

U.S. PATENT DOCUMENTS

| | | | | |
|---|---|---|---|---|
| 4,512,720 | A | 4/1985 | Cholakis | |
| 4,718,837 | A | 1/1988 | Frazzell | |
| 5,660,636 | A | 8/1997 | Shangold | |
| 6,328,528 | B1 * | 12/2001 | Dahlheimer | F04D 29/126 415/113 |
| 7,097,255 | B2 | 8/2006 | Drake | |
| 7,114,469 | B1 | 10/2006 | Taylor | |
| 7,264,520 | B1 | 9/2007 | Taylor | |
| 7,370,611 | B1 | 5/2008 | White | |
| 7,421,983 | B1 | 9/2008 | Taylor | |
| 8,500,501 | B1 | 8/2013 | Taylor | |
| 9,254,905 | B1 | 2/2016 | Randolph | |
| 9,527,568 | B1 | 12/2016 | Belter | |
| 2011/0038713 | A1 | 2/2011 | Harvie | |
| 2017/0328265 | A1 | 11/2017 | George | |

FOREIGN PATENT DOCUMENTS

| | | | |
|---|---|---|---|
| EP | 0103720 | A1 | 3/1984 |
| JP | 2004211619 | A | 7/2004 |

* cited by examiner

MARINE DRIVES AND COOLING PUMPS FOR MARINE DRIVES

FIELD

The present disclosure relates to marine drives, and specifically to marine drives having cooling fluid pumps.

BACKGROUND

The following U.S. Patents are incorporated herein by reference in entirety.

U.S. Pat. No. 9,254,905 discloses a cooling fluid pump for a cooling a marine engine that includes a pump chamber that contains an impeller. An upstream inlet passage supplies cooling fluid to the pump chamber. A downstream outlet passage discharges cooling fluid from the pump chamber. An impeller shaft rotates the impeller, causing flow of cooling fluid through the pump chamber from the inlet passage to the outlet passage. A drain passage connects the pump chamber to the inlet passage such that at least when the impeller is not rotating, the drain passage drains cooling fluid that settles by gravity in the pump chamber back to the inlet passage.

U.S. Pat. No. 9,527,568 discloses a stem drive for a marine vessel having an internal combustion engine that extends in a longitudinal direction, a horizontal direction that is perpendicular to the longitudinal direction, and a vertical direction that is perpendicular to the longitudinal direction and perpendicular to the horizontal direction. An engine output shaft extends in the longitudinal direction and is driven to rotate by the internal combustion engine. A cooling water sea pump is powered by rotation of the engine output shaft to pump cooling water to the internal combustion engine. The cooling water sea pump comprises a first pump input shaft that extends parallel to the engine output shaft, a second pump input shaft that extends transversely to the first pump input shaft and is driven to rotate by the first pump input shaft, and an impeller that is driven to rotate by the second pump input shaft to pump the cooling water to the internal combustion engine.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a pump for pumping cooling fluid to cool a marine drive comprises a pump housing defining a chamber and an impeller in the chamber. The impeller is rotatable about an axis, and the pump is configured to automatically adjust and maintain an axial compression force on the impeller so as to maintain a consistent seal between the impeller and the pump housing.

Optionally, a device biases the impeller into engagement with the pump housing to thereby maintain the consistent seal. Optionally, the device biases impeller into engagement with a first housing portion of the pump housing. Optionally, the device compresses the impeller against the pump housing. Optionally, the device is positioned in the chamber. Optionally, the device comprises a spring. Optionally, device comprises a plate that acts on the impeller. Optionally, the device is a first device, and further comprising a second device such that the first device and the second device compress the impeller therebetween. Optionally, the impeller is configured to be rotated by an output shaft of the marine drive. Optionally, the pump housing further comprises a pump inlet configured to permit passage of the cooling fluid into the chamber, and wherein pressure of the cooling fluid passing into the chamber opposes the bias of the device. Optionally, when the pressure of the cooling fluid received through the pump inlet is greater than a minimum pressure, the device is biased away from the impeller and the pressure of the cooling fluid maintains the consistent seal between the impeller and the pump housing.

In certain examples, a marine drive comprises an inlet configured to receive cooling fluid and a pump configured to pump the cooling fluid to cool a component of the marine drive. The pump comprises a pump housing that defines a chamber and an impeller compressed in the chamber. The impeller is rotatable about an axis, and the pump is configured to automatically adjust and maintain an axial compression force on the impeller so as to maintain a consistent seal between the impeller and the pump housing.

Optionally, the pump further comprises a device that biases the impeller into engagement with the pump housing to thereby maintain the consistent seal. Optionally, the device compresses the impeller against the pump housing. Optionally, the device biases impeller into engagement with a first housing portion of the pump housing. Optionally, the device biases impeller into engagement with a first housing portion of the pump housing. Optionally, the device is positioned in the chamber. Optionally, the pump further comprises an output shaft that rotates the impeller. Optionally, the pump housing comprises a pump inlet configured to permit passage of the cooling fluid into the chamber, and wherein pressure of the cooling fluid passing into the chamber opposes the bias of the device. In certain examples, a method of maintaining a consistent seal between an impeller and a pump housing of a pump that is for pumping cooling fluid to cool a marine drive comprises compressing the impeller in a chamber defined by the pump and maintaining a compression force on the impeller so as to maintain a consistent seal between the impeller and the pump housing.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DISCLOSURE

The present disclosure generally relates to marine drives, and specifically to marine drives that have one or more cooling fluid pumps that pump cooling fluid, such as cooling water from the body of water in which the marine vessel floats, through the marine drive to thereby cool one or more components of the marine drive and/or the marine vessel.

Figure 1:
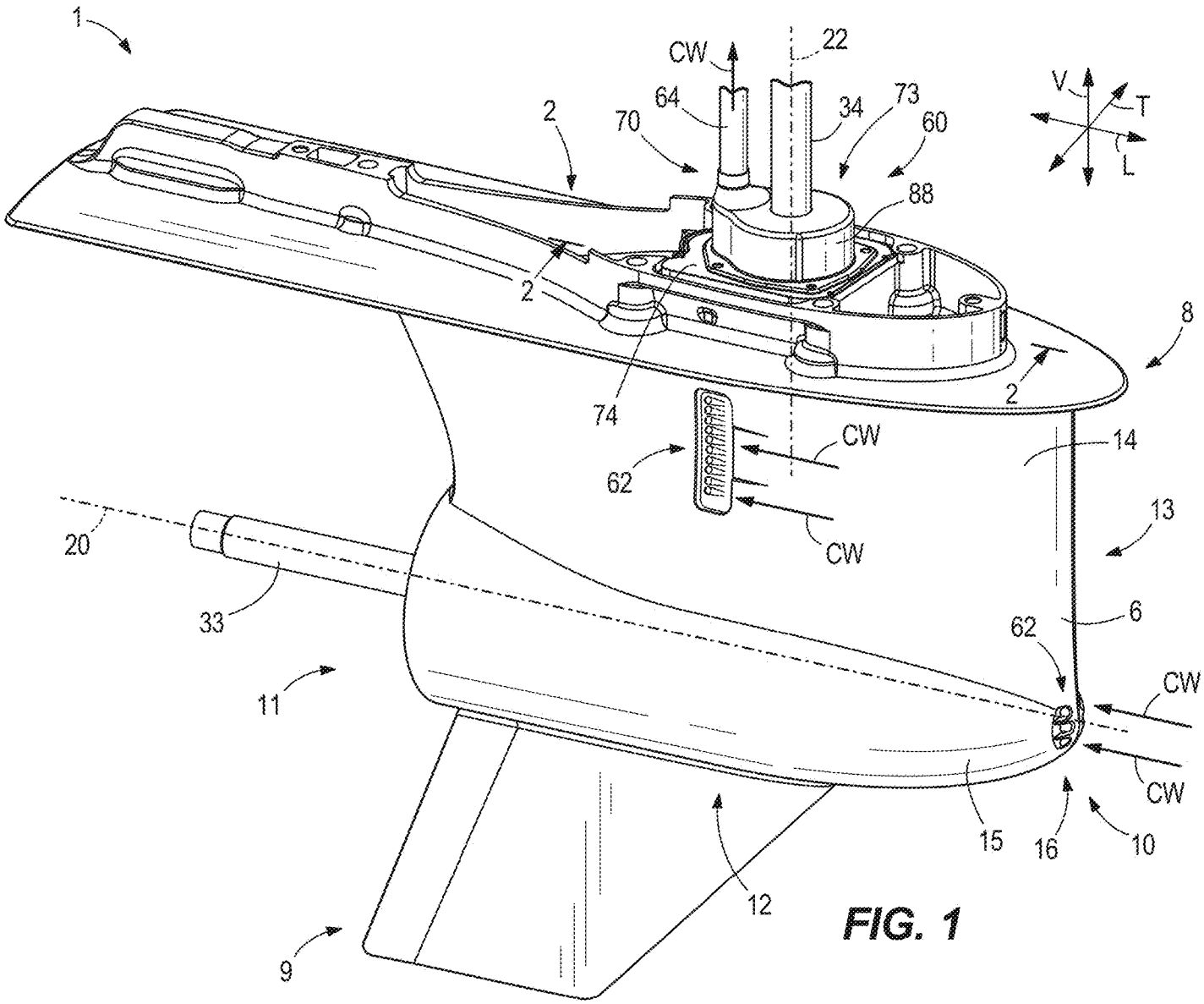
FIG. 1 is a perspective view of an example marine drive according to the present disclosure.
Figure 2:
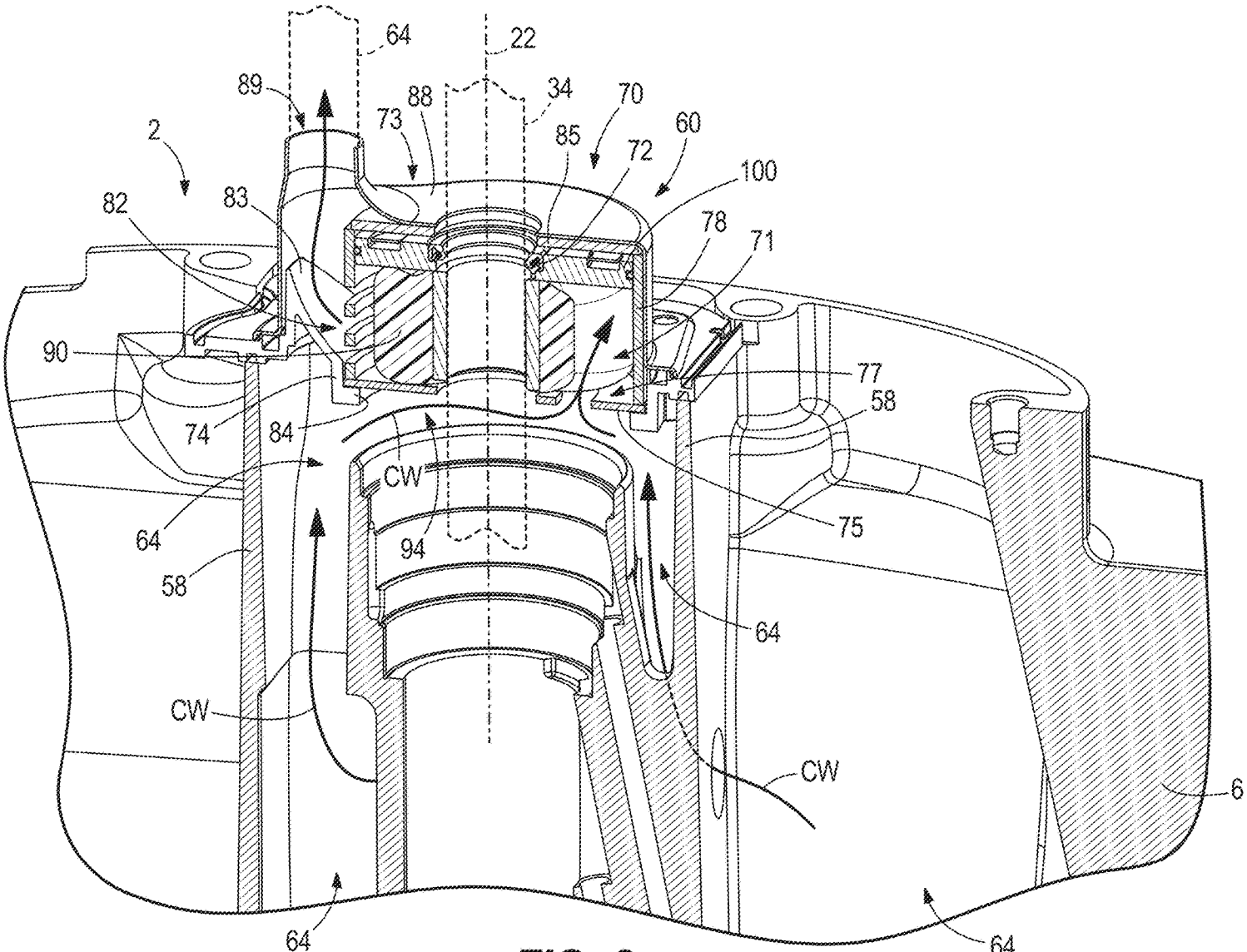
FIG. 2 is a cross-sectional view of the marine drive of FIG. 1 along line 2-2 on FIG. 1.

FIGS. 1-2 depict a lower portion of an exemplary marine drive 1, which includes a drive housing 2 having an upper casing (not depicted) and a lower casing 6 which are coupled together in a manner known in the art. The upper casing and the lower casing 6 may alternatively be integrally formed together or formed from more than two pieces. The drive housing 2 is configured to be coupled to, or otherwise integrated with, a marine vessel in a manner known in the art for propelling the marine vessel in water. The type and configuration of marine drive may vary and what is illustrated is merely exemplary.

The lower casing 6 extends between a top 8 and a bottom 9 (see first axis V), longitudinally between a first end 10 and a second end 11 (see longitudinal second axis L), and transversely between opposing sides 12, 13 (see transverse third axis T). The lower casing 6 includes an upper housing 14 and a torpedo housing 15 below the upper housing 14. The torpedo housing 15 extends between the first and second ends 10, 11, along a longitudinally extending axis 20, and defines an internal cavity. The torpedo housing 15 includes a nose 16 that is at the first end 10 of the lower casing 6.

A powerhead (not depicted) of the marine drive 1 may include an engine, an electric motor, a hybrid engine/motor, and/or any other means for powering a marine drive. The powerhead has an output shaft 34 that extends along an output shaft axis 22. The output shaft 34 is configured to rotate a propulsor shaft 33 which extends from the torpedo housing 15 along the axis 20. The propulsor shaft 33 rotates a propulsor (not depicted), such as a jet, an impeller, a propeller, a combination impeller and propeller, and/or the like, which is operatively coupled to the propulsor shaft 33 outside of the torpedo housing 15. The propulsor thereby provides propulsion for a marine vessel in the water. The output shaft 34 transmits rotation to the propulsor shaft 33 in a manner known in the art, including directly connecting to the output shaft, or indirectly through gears, pulleys, or additional shafts with couplers, for example. It should be recognized that while the present disclosure primarily locates the propulsor on the propulsor shaft 33 being aft of the torpedo housing 15, the present disclosure also relates to other types and configurations of propulsor devices, including tractor or pulling-type propulsion devices. Note that one or more bearings and/or one or more seals (e.g., rings) (not depicted) can be provided around the propulsor shaft 33.

The marine drive 1 includes an open-loop, cooling fluid system 60 configured to draw in cooling fluid, e.g., cooling water, from the body of water in which the marine vessel operates. The cooling water enters the cooling fluid system 60 via one or more inlets 62 (FIG. 1) located on the drive housing 2. For the non-limiting example depicted in FIG. 1, a first inlet 62 is located at the nose 16 of the torpedo housing 15 and a second inlet 62 is located on the upper housing 14. An outlet (not depicted) is located on the drive housing 2 or another component of the marine drive 1 through which the cooling water is discharged back to the body of water. The cooling water flows through one more conduits 64 (FIG. 2) between the inlet 62 and the outlet. Note that FIG. 2 depicts several conduits 64 and cooling water flow paths (arrows CW).

A cooling fluid pump 70 is located in the drive housing 2 and is in fluid communication with the inlet 62 via the conduits 64. Generally, the pump 70 is configured to pump the cooling water received via the inlet 62 through the conduits 64 and the outlet (not depicted) such that the cooling water flows through and/or adjacent to various components of the marine drive 1 to thereby cool one or more components of the marine drive 1. For example, the cooling water is pumped through one or more water jackets and/or passages such that heat is exchanged with an adjacent marine drive component (e.g., cooling water is pumped through an exhaust tube water jacket that facilitates cooling of an exhaust tube, cooling water is pumped through a water passage in or on a cylinder block and/or a cylinder head such that the cooling water cools the of the cylinder block and/or the cylinder head). In non-limiting examples, the cooling fluid system 60 includes a recirculation pump (not depicted) that is configured to recirculate relatively warm cooling water already within the cooling fluid system 60 into the relatively cooler cooling water received via the inlet 62.

Figure 3:
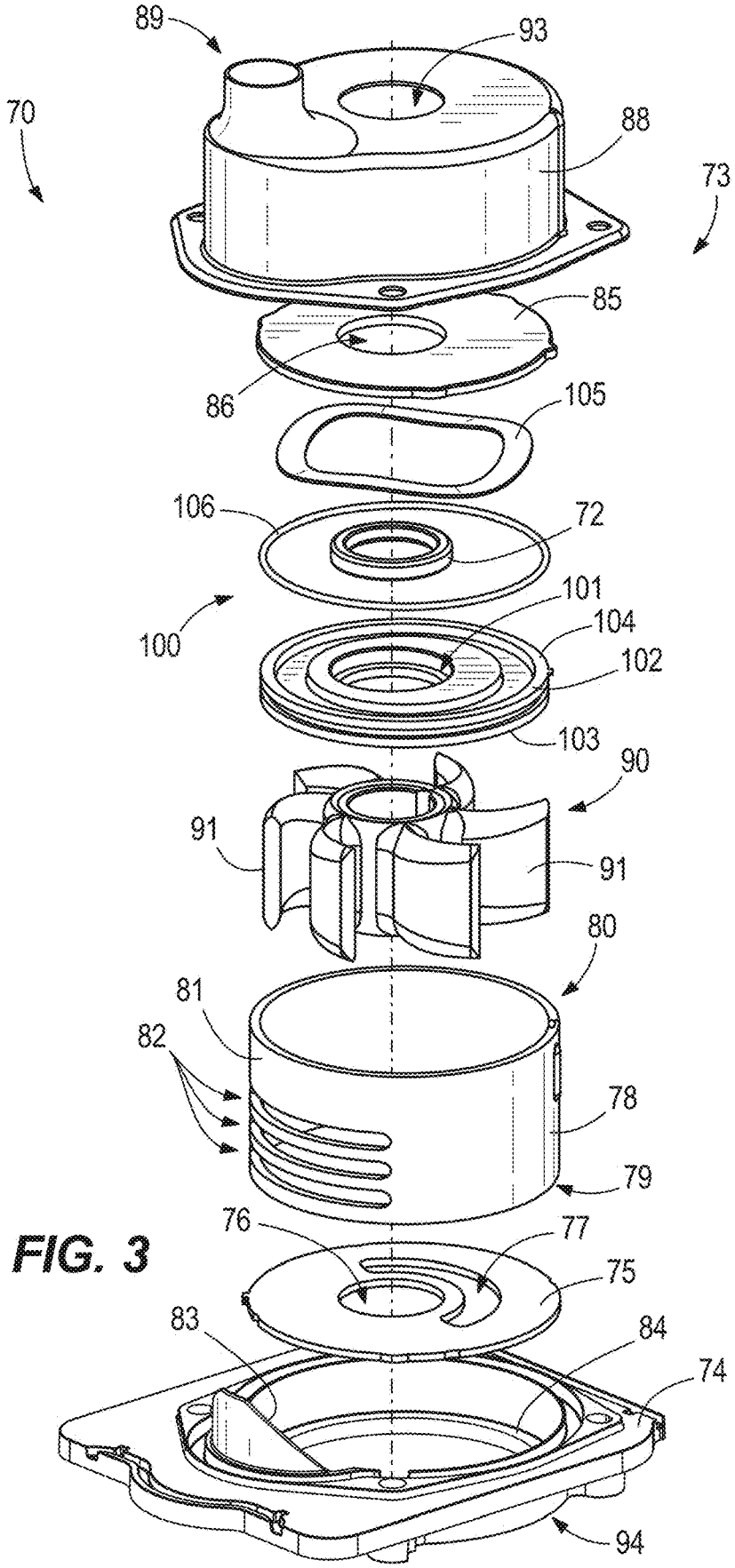
FIG. 3 is an exploded view of an example cooling fluid pump of the marine drive of FIG. 1.
Figure 4:
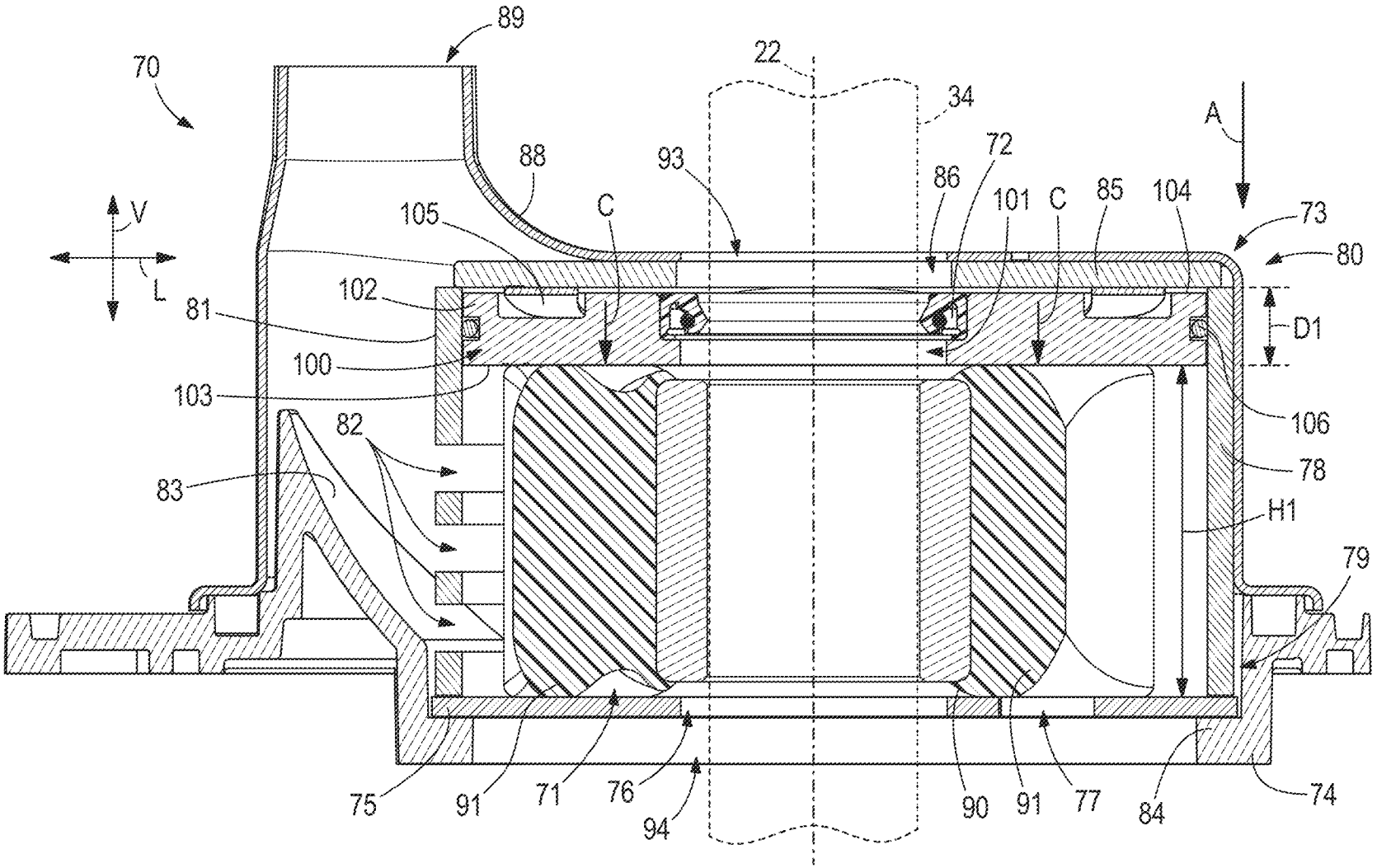
FIG. 4 is a cross-sectional view of the example cooling fluid pump of FIG. 2 with a device in a first position.
Figure 5:
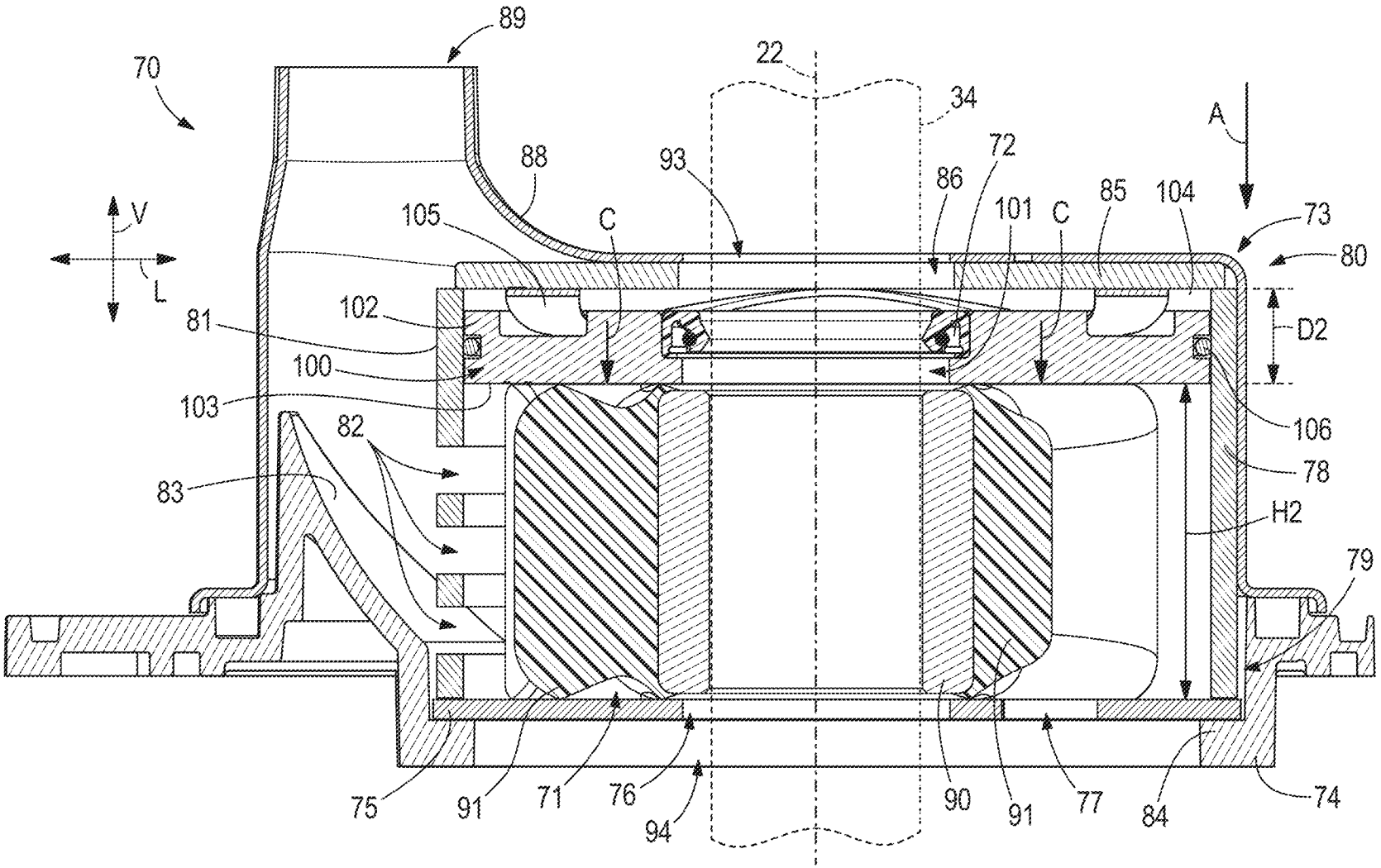
FIG. 5 is a cross-sectional view of the example cooling fluid pump of FIG. 2 with a device in a second position.

Turning now to FIGS. 3-5, the pump 70 depicted in FIGS. 1-2 is depicted in greater detail. The pump 70 includes a pump housing 73 defining a chamber 71 (see FIG. 4) in which an impeller 90 and a device 100 for maintaining a consistent seal between the impeller 90 and pump housing 73 (described in greater detail hereinbelow) are located. The pump housing 73 includes a mounting flange 74 that is secured to one or more mounting elements 58 (see FIG. 2; e.g., portions of the drive housing 2, plates, flanges and/or the like). The mounting flange 74 has a lip 84 that radially inwardly extends into chamber 71. The mounting flange 74 also defines an opening 94 through which the cooling water is received from the conduits 64 (FIG. 2). The output shaft 34 of the marine drive 1 extends through the opening 94. One or more bearings 72 are provided between the pump 70 and the output shaft 34 and facilitate rotation of the output shaft 34 relative to the pump housing 73.

A first housing portion 75 of the pump housing 73 is supported on the lip 84. The first housing portion 75 defines an output shaft opening 76 through which the output shaft 34 extends. The output shaft opening 76 is eccentrically positioned in the first housing portion 75 such that the output shaft 34 does not extend through the geometric center of the first housing portion 75. The first housing portion 75 defines a pump inlet 77 that permits cooling water to pass therethrough into the chamber 71. The pump inlet 77 is a curved opening that radially extends about the output shaft axis 22 and is offset from the output shaft opening 76. In certain examples, the pump inlet 77 has an arch shape or semi-annular shape.

A second housing portion 78 of the pump housing 73 is supported on the first housing portion 75. The second housing portion 78 has a first end 79 adjacent to the first housing portion 75 and an opposite second end 80 that is adjacent to a third housing portion 85 (described hereinbelow). The second housing portion 78 is sandwiched between the first housing portion 75 and the third housing portion 85. The second housing portion 78 is generally cylindrical with a perimeter sidewall 81 that defines a radial perimeter of the chamber 71. The second housing portion 78 defines one or more radial passageways 82 (described in greater detail below), and the pump 70 pumps the cooling water through the radial passageways 82.

As noted above, the third housing portion 85 is at the second end 80 of the third housing portion 85. The third housing portion 85 defines an output shaft opening 86 through which the output shaft 34 extends. The output shaft opening 86 is aligned with the output shaft opening 76 of the first housing portion 75.

The first, second, and third housing portions 75, 78, 85 form a rigid frame-type structure defining the chamber 71. The impeller 90 and the device 100 (described hereinbelow) are positioned in the chamber 71. The impeller 90 is coupled to the output shaft 34, which extends through the pump 70 such that the impeller 90 rotates with the output shaft 34. The impeller 90 includes plurality of radially extending fins 91 that engage the first and second housing portions 75, 78 and/or the device 100. As further described herein below, the impeller 90 is axially compressed between the device 100 and the first housing portion 75 thereby creating fluid-tight seals between the impeller 90 and the first and second housing portions 75, 78 and/or the above-noted device 100.

In the non-limiting example shown in the figures, the device 100 is positioned between the impeller 90 and the third housing portion 75. In this example, the device 100 includes a plate 102 that defines an output shaft opening 101 through which the output shaft 34 extends. The output shaft opening 101 of the device 100 is aligned with the output shaft openings 76, 86 of the first and third housing portions 75, 85. The device 100 also includes a resilient member, which in the illustrated example includes a spring 105. The spring 105 could be a compression spring, a leaf spring and/or the like. The spring 105 is configured to bias the plate 102 in a first direction (see arrow A on FIG. 4) toward the impeller 90. A gasket or O-ring 106 is positioned between the plate 102 and the second housing portion 78 thereby creating fluid-tight seal therebetween.

During operation of the marine drive 1, the impeller 90 rotates with the output shaft 34, which causes the impeller 90 to pump cooling water through the radial passageways 82 in the second housing portion 78. A deflection surface 83 of the mounting flange 74 directs the cooling water toward a pump outlet 89 that is defined in a fourth housing portion 88. The fourth housing portion 88 covers the second and third housing portions 78, 85, and the fourth housing portion 88 is secured to the mounting flange 74 via one or more fasteners (e.g., screws, bolts). The pump outlet 89 is coupled to a conduit 64 (see FIG. 1) through which the cooling water passes to thereby cool one or more components of the marine drive 1, as described above. One or more gaskets or O-rings (not depicted) can be included between any of the housing portions 75, 78, 85, 88 and/or the mounting flange 74 to thereby create fluid-tight seal(s) therebetween. The fourth housing portion 88 includes an output shaft opening 93 that is aligned with the output shaft opening 76 of the first housing portion 75.

As the impeller 90 is rotated, the exterior surfaces of the impeller 90 and/or the fins 91 engage with and move along the device 100 and/or the housing portions 75, 78. As such, frictional forces are generated between the impeller and the device 100 and/or the housing portions 75, 78. During research and experimentation, the present inventors have determined that, over time, the frictional forces tend to weaken (e.g., make less-rigid) and/or wear down the material forming the impeller 90. In certain examples, the frictional forces tend to wear down the impeller 90 such that the axial height of the impeller 90 decreases.

The present inventors have made similar observations when examining conventional pumps with impellers and realized that decreases in axial height of the impeller disadvantageously causes a reduction in the compressive forces acting on the impeller because the impeller of conventional pumps is located within a pump housing having a fixed chamber height. As such, as the axial height of the impeller decreases, the amount of compression forces acting on the impeller also decreases. The decrease in compressive forces acting on the impeller may cause a reduction or loss of the seal between the impeller and the inner surfaces of the pump housing. That is, reduced compressive forces acting on the impeller cause the impeller to not properly seal or maintain the seal between the impeller and the pump housing. Accordingly, the efficiency of the pump decreases and/or costly and time-consuming repairs may be necessary to repair or replace the worn impeller and/or the pump housing.

During research and experimentation, the present inventors also recognized in certain examples, the impeller of conventional pumps may be 'pre-loaded' with compression forces prior to rotation of the impeller so that the consistent seal between the impeller and the pump housing is present when the impeller begins to rotate. Absence of the consistent seal when the impeller begins to rotate decreases pump efficiency. In addition, the present inventors recognized that manufacturing tolerances of impellers and pump housing of conventional pumps can vary. As such, there is a need to ensure that impellers are sufficiently compressed so that the consistent seal is formed and/or maintained as the pump begins operation and during operation.

To account for the problems noted above (e.g., decreasing compressive forces acting on the impeller and/or the loss of consistent seal with the pump housing, lack of seal at start of impeller rotation), the present inventors developed the pump 70 of the present disclosure which is advantageously configured to automatically adjust and maintain a sufficient axial compression force on the impeller 90 so as to create and/or maintain a consistent seal between the impeller 90 and the housing portions 75, 78 of the pump housing 73 and/or the device 100. More specifically, the device 100 is specially configured to bias the impeller 90 in a first direction (arrow A) such that as the impeller 90 weakens and/or wears, the device 100 automatically adjusts to maintain a sufficient axial compression force on the impeller 90. As such, the impeller 90 remains axially compressed between the device 100 and the first housing portion 75 with sufficient axial compression force so as to create and/or maintain the consistent seal between impeller 90 and the housing portions 75, 78 of the pump housing 73 and/or the device 100. Accordingly, the example pumps 70 of the present disclosure 'pre-load' the impeller 90 prior to operation of the pump 70, potentially maintain pumping efficiency for longer period of times relative to conventional pump, and potentially reduce pump maintenance costs by eliminating replacement of the impeller 90 or at least reducing the number of times the impeller 90 must be replaced during the life of the pump 70.

In non-limiting examples, the resilient member (such as a spring 105) biases the plate 102 axially toward the impeller 90 such that the plate 102 applies a compressive force on the impeller 90. As such, the seal(s) between the impeller 90 between the impeller 90 and the plate 102 and the first and second housing portions 75, 78 are created and maintained. In this example, the impeller 90 is axially compressed between the plate 102 and the first housing portion 75.

Referring now to FIGS. 4-5, an example pump 70 according to the present disclosure is depicted in greater detail. FIG. 4 depicts the device 100 in a first position such as when the pump 70 is first assembled. The plate 102 has a lower first surface 103 that faces the impeller 90 and an opposite second surface 104 that faces the third housing portion 85. While the device 100 is in the first position (FIG. 4), the first surface 103 is a first distance D1 away from the third housing portion 85, the spring 105 is axially compressed between the third housing portion 85 and the plate 102, and the plate 102 is biased in the first direction (arrow A). As such, compression forces (see arrows C) act on the impeller 90 and the seal(s) between the impeller 90 and the plate 102 and/or the first and second housing portions 75, 78 are maintained. Note that the axial height of the impeller 90 is a first axial height H1.

As the pump 70 is operated and over time, the device 100 (and specifically the spring 107) is configured to automatically adjust the position of the plate 102 within the chamber 71 to thereby maintain contact between the plate 102 and the impeller 90 and thereby maintain sufficient compression forces on the impeller to thereby maintain the seal(s) (noted above). FIG. 5 depicts the device 100 moved into a second position as the spring 107 decompresses such that the first surface 103 of the plate 102 is a second distance D2 away from the third housing portion 85. The second distance D2 is greater than the first distance D1 (FIG. 4). In this example, the spring 107 decompresses in response to wearing of the impeller 90. The worn impeller 90 has a second axial height H2 that is less than the first axial height H1 (FIG. 4). However, even though the axial height H2 of the impeller 90 has decreased (relative to the axial height H1 of the impeller 90 when the device 100 is in the first position as depicted in FIG. 4), the device 100 still maintains a sufficient axial compression force on the impeller 90 so as to create and/or maintain the consistent seal between the impeller 90 and the housing portions 75, 78 of the pump housing 73 and/or the device 100.

Referring back to FIG. 2, during operation of the marine drive 1 and propulsion of the marine vessel in the body of water, the cooling water may automatically enter the water inlets 62 (FIG. 1). The cooling water is caused to flow through the inlets 62 under the force of ram pressure resulting from the movement of the marine drive 1 through the body of water. Ram pressure is water pressure exerted on the marine drive 1 as it is moved through the body of water. As the ram pressure of the cooling water entering the cooling fluid system 60 via the inlet 62 increases, the pressure of the cooling water entering the chamber 71 via the pump inlet 77 also increases. The increased pressure of the cooling fluid received into the chamber 71 opposes the compression forces applied by the device 100. As such, after the pressure of the cooling fluid received into the chamber 71 is greater than a minimum pressure the plate 102 if the device 100 is biased away from the impeller 90 and the pressure of the cooling fluid maintains the seal(s) of the impeller 90 and the housing portions 75, 78 of the pump housing 73 and/or the device 100. The ram pressure of the cooling water may also advantageously reduce wear of the impeller 90 and/or the pump housing 73. In certain examples, the minimum pressure is greater than atmospheric pressure.

In other examples, the device 100 noted above with respect to FIGS. 4-5 is a first device 100 and the pump 70 further includes a second device (not depicted) positioned to bias the first housing portion 75 into engagement with the impeller 90. The second device may be positioned between the first housing portion 75 and the lip 84 of the mounting flange 74. In these examples, the first and second devices are collectively configured to apply compression forces to the impeller 90 so as to create and/or maintain the consistent seal between the impeller 90 and the housing portions 75, 78 of the pump housing 73 and/or the devices.

In some examples, the device 100 noted above with respect to FIGS. 4-5 is a positioned to bias the first housing portion 75 into engagement with the impeller 90. Specifically, the device 100 is positioned between the first housing portion 75 and the lip 84 of the mounting flange 74. In this example, the device 100 compresses the impeller 90 against the third housing portion 85 so as to create and/or maintain the consistent seal between the impeller 90 and the housing portions 78, 85 of the pump housing 73 and/or the device 100.

In certain examples, a pump for pumping cooling fluid to cool a marine drive comprises a pump housing defining a chamber and an impeller in the chamber. The impeller is rotatable about an axis, and the pump is configured to automatically adjust and maintain an axial compression force on the impeller so as to maintain a consistent seal between the impeller and the pump housing.

Optionally, a device biases the impeller into engagement with the pump housing to thereby maintain the consistent seal. Optionally, the device biases impeller into engagement with a first housing portion of the pump housing. Optionally, the device compresses the impeller against the pump housing. Optionally, the device is positioned in the chamber. Optionally, the device comprises a spring. Optionally, device comprises a plate that acts on the impeller. Optionally, the device is a first device, and further comprising a second device such that the first device and the second device compress the impeller therebetween. Optionally, the impeller is configured to be rotated by an output shaft of the marine drive. Optionally, the pump housing further comprises a pump inlet configured to permit passage of the cooling fluid into the chamber, and wherein pressure of the cooling fluid passing into the chamber opposes the bias of the device. Optionally, when the pressure of the cooling fluid received through the pump inlet is greater than a minimum pressure, the device is biased away from the impeller and the pressure of the cooling fluid maintains the seal between the impeller and the pump housing.

In certain examples, a marine drive comprises an inlet configured to receive cooling fluid and a pump configured to pump the cooling fluid to cool a component of the marine drive. The pump comprises a pump housing that defines a chamber and an impeller compressed in the chamber. The impeller is rotatable about an axis, and the pump is configured to automatically adjust and maintain an axial compression force on the impeller so as to maintain a consistent seal between the impeller and the pump housing.

Optionally, the pump further comprises a device that biases the impeller into engagement with the pump housing to thereby maintain the seal. Optionally, the device compresses the impeller against the pump housing. Optionally, the device biases impeller into engagement with a first housing portion of the pump housing. Optionally, the device biases impeller into engagement with a first housing portion of the pump housing. Optionally, the device is positioned in the chamber. Optionally, the pump further comprises an output shaft that rotates the impeller. Optionally, the pump housing comprises a pump inlet configured to permit passage of the cooling fluid into the chamber, and wherein pressure of the cooling fluid passing into the chamber opposes the bias of the device.

In certain examples, a method of maintaining seal between an impeller and a pump housing of a pump that is for pumping cooling fluid to cool a marine drive comprises compressing the impeller in a chamber defined by the pump and maintaining a compression force on the impeller so as to maintain a consistent seal between the impeller and the pump housing.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A pump for pumping cooling fluid to cool a marine drive, the pump comprising:

a pump housing defining a chamber between two housing portions;

an impeller in the chamber and rotatable about an axis; and a device in the chamber axially between one of the housing portions and the impeller to bias the impeller into engagement with the other housing portion and automatically adjust and maintain an axial compression force on the impeller so as to maintain a consistent seal between the impeller and the pump housing.

2. The pump according to claim 1, wherein the device maintains the seal between the impeller and the other housing portion.

3. The pump according to claim 2, wherein the device further maintains a seal between the device and the impeller.

4. The pump according to claim 1, wherein the device compresses the impeller against the pump housing.

5. The pump according to claim 1, wherein the two housing portions are a first housing portion and a third housing portion and the pump further comprises a second housing portion axially extending between the first housing portion and the third housing portion, and wherein the device compresses the impeller to maintain the seal between the impeller and the first housing portion and a seal between the impeller and the second housing portion.

6. The pump according to claim 1, wherein the device comprises a spring.

7. The pump according to claim 1, wherein the device comprises a plate that acts on the impeller.

8. The pump according to claim 1, wherein the device is a first device, and further comprising a second device that biases the other housing portion into engagement with the impeller such that the first device and the second device compress the impeller therebetween.

9. The pump according to claim 1, wherein the impeller has an exterior surface that engages with the other housing portion when the device biases the impeller into engagement with the other housing portion such that the seal is maintained between the exterior surface and the other housing portion.

10. The pump according to claim 1, wherein the pump housing further comprising a pump inlet configured to permit passage of the cooling fluid into the chamber, and wherein pressure of the cooling fluid passing into the chamber opposes the bias of the device.

11. The pump according to claim 10, wherein when the pressure of the cooling fluid received through the pump inlet is greater than a minimum pressure, the device is biased away from the impeller and the pressure of the cooling fluid maintains the consistent seal between the impeller and the pump housing.

12. A marine drive comprising:

an inlet configured to receive cooling fluid; and a pump configured to pump the cooling fluid to cool a component of the marine drive, the pump comprising a pump housing that defines a chamber between two housing portions, an impeller compressed in the chamber and rotatable about an axis, and a device in the chamber axially between one of the housing portions and the impeller to compress the impeller into engagement with the other housing portion and automatically adjust and maintain an axial compression force on the impeller so as to maintain a consistent seal between the impeller and the pump housing.

13. The marine drive according to claim 12, wherein the device maintains the seal between the impeller and the other housing portion.

14. The marine drive according to claim 12, wherein the device compresses the impeller against the pump housing.

15. The marine drive according to claim 13, wherein the device further maintains a seal between the device and the impeller.

16. The marine drive according to claim 12, wherein the two opposing housing portions are a first housing portion and a third housing portion and the pump comprises a second housing portion axially extending between the first housing portion and the third housing portion, and wherein the device compresses the impeller to maintain the seal between the impeller and the first housing portion and a seal between the impeller and the second housing portion.

17. The marine drive according to claim 16, wherein the device comprises a plate and a o-ring, wherein the o-ring is positioned between the plate and the second housing portion to thereby create a seal therebetween.

18. The marine drive according to claim 12, wherein the device is a first device, and the pump further comprises a second device that biases the other housing portion into engagement with the impeller such that the first device and the second device compress the impeller therebetween.

19. The marine drive according to claim 13, wherein the pump housing further comprising a pump inlet configured to permit passage of the cooling fluid into the chamber, and wherein pressure of the cooling fluid passing into the chamber opposes the bias of the device.

20. A method of maintaining a consistent seal between an impeller and a pump housing of a pump that is for pumping cooling fluid to cool a marine drive, the method comprising:

compressing the impeller in a chamber defined between two housing portions of the pump; and maintaining a compression force on the impeller with a device positioned between one of the housing portions and the impeller so as to compress the impeller into engagement with the other housing portion and maintain the consistent seal between the impeller and the pump housing.

* * * * *